US005127168A

United States Patent [19]

Pikulik

[11] Patent Number: 5,127,168

[45] Date of Patent: Jul. 7, 1992

[54] METHOD FOR MANUFACTURE OF SMOOTH AND GLOSSY PAPERS AND APPARATUS

[75] Inventor: Ivan I. Pikulik, Pointe Claire, Canada

[73] Assignee: Pulp and Paper Research Institute of Canada, Pointe Claire, Canada

[21] Appl. No.: 696,731

[22] Filed: May 7, 1991

Related U.S. Application Data

[63] Continuation of Ser. No. 382,725, Jul. 20, 1989, abandoned.

[51] Int. Cl.[5] ..... F28B 7/00

[52] U.S. Cl. ..... 34/18; 34/23

[58] Field of Search ..... 34/16, 18, 23, 153, 34/152, 154, 111; 162/358, 359, 361, 360.1

[56] References Cited

U.S. PATENT DOCUMENTS 1,873,949 8/1932 Williams .
1,951,710 3/1934 Schorger .
3,131,118 4/1964 Dabroski ..... 162/361
4,915,026 4/1990 Halme ..... 162/360.1

*Primary Examiner*—Henry A. Bennet
*Attorney, Agent, or Firm*—Swabey Ogilvy Renault

[57] ABSTRACT

A method and a machine are described for drying of fibrous web, especially suitable for high speed machines producing printing papers. High drying rates are obtained by subsequently pressing the two surfaces of wet web onto two large diameter dryer cylinders heated to between 100° and 150° C. In the first nip, the web is pressed on the dryer cylinder by a felted press roll, while and unfelted smooth roll is used to press the web on the second dryer. Drying rates obtained when practicing the invention are substantially greater than those found in conventional dryer sections. The product obtained according to this method is 30% stronger than the conventionally dried uncalendered paper, and without calendering has a smoothness and gloss similar to those of calendered conventional papers.

12 Claims, 6 Drawing Sheets

METHOD FOR MANUFACTURE OF SMOOTH AND GLOSSY PAPERS AND APPARATUS

This is a continuation of application Ser. No. 382,725, filed Jul. 20, 1989, now abandoned.

BACKGROUND OF THE INVENTION

1. Field of invention

The present invention relates to a continuous process, and apparatus for drying wet fibrous webs, and more particularly, it applies to the drying of wet printing papers such as newsprint. A new drying method is disclosed which, compared with the conventional method, employs a smaller number of dryers, leads to better machine runnability, and yields products with greater tensile strength, better surface properties and printing characteristics. This method is particularly suitable for drying wet cellulosic webs intended for printing products such as newsprint and bond paper.

2. Description of Prior Art

In the production of paper, a suspension of cellulosic fibres is ejected on an advancing forming fabric which retains a large portion of fibres and fine cellulosic material, and transmits a large portion of water. Additional water is removed from the wet cellulosic web by mechanical compression between two rotating press rolls. Water remaining in the pressed web is removed by evaporation in a dryer section of the paper machine.

Two elementary processes involved in paper drying are the heat transfer from the heating medium into the wet web (i.e. heat transfer) and transportation of water vapours away from the substance (i.e. mass transfer). The heat transfer is proportional to the temperature difference between the heat source and the wet web, and inversely proportional to the heat transfer resistance by the boundary layers between the web and the source of heat. An intimate contact between the heating surface and the wet web is, therefore, desirable for good heat transfer. A high temperature of the heat source is also desirable, however, the temperature of the dryer is limited by some practical considerations. For example, if the wet web is in contact with a very hot body, an insulating layer of steam is formed between the heat source and the web, and the rate of heat transfer is reduced. The high temperature of dryers could cause a reduction in paper quality. High temperature operation of steam heated dryers, also requires elevated steam pressures.

The evaporation of water from wet webs at temperatures below the boiling point of water is possible only if water vapours are carried away from the web by the drying air. The rate of this mass transfer is reduced if the web is insulated from the surrounding air by, for example, a drying fabric. On the other hand, mass transfer is enhanced by impingement of hot air on the web.

In the most common method of paper drying, the web is passed around a series of internally-heated rotating cylinders known as "dryers", which are usually arranged in an upper and a lower row. The advancing web is heated by direct contact with a portion of the cylinder surface. This drying method is well known, and is described for example in U.S. Pat. No. 2,299,460. To improve the web-dryer contact, the wet web is often sandwiched to the dryer surface by dryer fabrics. One such fabric might wrap a part of the surface of the upper row of dryers, while another dryer fabric might wrap the bottom part of the lower row of dryers.

One disadvantage associated with this method of drying is the large number of cylinders required to dry the paper. For example, 1986 survey of Canadian newsprint dryers revealed that the majority of machines operating at, or above 800 m/min had between 35 and 50 dryers, with diameters of 1.5 m or 1.8 m (N. N. Sayegh, I. I. Pikulik, and H. I. Simonsen, Pulp Paper Can, Dec. 1987).

Such a large number of dryers represents extensive capital, operating and maintenance costs, and also contributes to the great length of the machine, and to a large demand for building space. Another disadvantage of conventional paper drying methods is the transfer of unsupported, weak, wet web between two consecutive cylinders. At high machine speeds, the wet web passing unsupported through the air is unstable and, reacting to small variations in the process, has a tendency to oscillate or "flutter". An excessive sheet flutter can cause deformations and wrinkling of the sheet, reducing the product quality, or completely breaking the sheet and interrupting production. To reduce the frequency of sheet breaks, the machine speed is sometimes kept low, even though this leads to a decrease in production.

To reduce the problems associated with the movement of unsupported sheets between cylinders, on some rapidly operating paper machines, the wet paper proceeds around the initial drying cylinders adjacent to a single drying fabric. With this single felted arrangement, the paper is suported by the fabric as it advances between the dryers, which reduces the tendency of the web to flutter, and the frequecy of the breaks.

The single felted arrangement is used primarily, but not exclusively, on the initial section of cylinders where the sheet is very moist and weak, while the open draw is utilized between the remaining drying cylinders. Application of a single drying fabric in a serpentine configuration is described for example in U.S. Pat. No. 4,172,007.

A disadvantage of the single felted run is that only one half of dryers (usually those in the upper row) come into direct contact with the paper, while the other half of dryers are separated from the paper by the dryer fabric which reduces the amount of heat transferred from these dryers to wet web. Consequently, more dryers, or higher dryer temperatures are required with the serpentine arrangement of dryer felt.

Recently, a dryer section called "total Bel Run" was described in which the serpentine arrangement was extended over the whole length of the dryer section. While in the regular serpentine run the bottom row of cylinders is separated from wet web by drying fabric, in the Total Bel Run, the bottom cylinders are replaced by small diameter vacuum rolls (Beloit Canada Technical Seminar, Montreal Jan. 26, 1988). Such a dryer section is capable of operating at high speeds, but has the disadvantage of being even longer than the conventional dryer section.

Another method sometimes used for drying paper employs the "Minton Dryer" (U.S. Pat. No. 1,147,809) in which the drying cylinder is located within a large evacuated chamber. At the decreased air pressure, the boiling point of water is reduced, which could potentially increase the rate of heat transfer. The disadvantage of Minton dryers is that, in the absence of drying fabrics, the intimate contact between the dryer and the web is not established, and the rate of heat transfer is low. Another problem associated with the Minton Dryer is the necessity to disrupt the vacuum whenever a sheet break occurs. In the absence of any support for the wet web during the transfer between dryers, this method cannot be used on fast machines.

In yet another drying method, the wet web is supported by jets of heated gas which provide the heat required for the evaporation of water, and carry away water vapours. This operation is described for example in U.S. Pat. No. 3,739,491. The heat transfer rates achieved with this method are high, and the mechanical stress on the wet web is low. However, the cellulosic web dried without contact with a supporting medium shrinks unevenly and subsequently develops undesirable deviation from polarity called cockle, which lowers the product quality and might lead to wrinkles or cuts during calendering. Difficulties with threading the dryer after a web break are another disadvantage of this drying method, presently used mainly for heavy basis weight grades or for initial drying of light basis weight products.

In a different method, the web is dried entirely on a single, large-diameter, rotating, steam-heated cylinder known as "MG cylinder" or "Yankee dryer". A notable feature of web drying on a single cylinder is that the initial contact between the dryer surface and the web is established in a press nip. A metal, rubber covered press roll wrapped by a press felt or a fabric, presses the web onto the dryer surface by a force of about 30 to 80 kN/m. Upon pressing the soft wet-web fibres establish an intimate contact with the surface of the dryer which leads to a high heat transfer and drying rates. On the majority of fast modern Yankee machines, the drying rate is further enhanced by impingement of hot air on the paper adhering to the dryer surface. The jets of preheated air come from the so called "high velocity" hood, which surrounds a large portion of the Yankee dryer. Typically, about half of the drying energy is derived from the steam inside the Yankee dryer, while the other half is supplied by the hot air.

When paper is completely dried on a single, large diameter dryer, it adheres strongly to the dryer surface and cannot be safely peeled off without breaking the sheet, especially if the basis weight of the paper is low. In production of creped tissue paper, the web is dried entirely on a single Yankee dryer, and the dry product is separated from the dryer surface by a creping blade. The separated paper is densely wrinkled by the action of the blade, and usually has from 25 to 120 crepe ridges per inch. Paper creped in this manner has low tensile strength, high bulk, softness and water absorbency, and a rough surface. These properties make creped paper a good material for hygienic products, but unsuitable for application as a printing paper.

Heavier basis weight, often partially dried, cellulosic webs are sometimes also pressed to large diameter driers, called MG cylinders. These stronger and less adhesive webs might be peeled from the dryer surface, giving a product which has one side smooth and glossy, or "machine glazed" (hence MG cylinder). However, two sides of a product treated in this way are very different, namely the web side which was in contact with the dryer surface becomes smoother and glossier than the reverse side. Such a product is suitable for products such as folding boxes in which only one side is visible, while lower demands are placed on the board side inside the box. Thus Yankee drying is presently used especially for light basis weight hygienic or wrapping papers which are removed from the dryer by a creping blade, and MG cylinders are used for some paperboard products in which the difference in the two paper sides is desirable.

Recently, another method of water removal was described (U.S. Pat. No. 4,324,613) in which the cellulosic web is pressed to a cylinder heated to temperatures much higher than the boiling point of water, for example 150°-250° C. This process, sometimes called "Impulse Drying" is based on the generation of high pressure steam on contact of the wet web with the hot dryer surface in the press nip. The front of high pressure steam formed at the wall of the hot dryer advances rapidly through the paper thickness and expels a large proportion of liquid water contained in the cellulosic web into the adjacent felt. Since the prevalent portion of water is removed in liquid form, this process is a special case of paper pressing, rather than paper drying. Large steam pressure on the boundary of the roll and the paper causes the paper to separate from the roll immediately upon its exit from the nip. Disadvantages of paper drying include product two-sidedness and, under certain conditions, splitting of paper to two plies by high steam pressure within the sheet. Generation of steam in the press nip requires a certain nip residence time, which might limit the usefulness of this drying method for high-speed machines. No commercial high speed Impulse Drying installation exists at the present time.

The essential requirements of printing paper include good surface smoothness, identical properties of two paper sides, and resistance of the superficial fibres and fines to their removal by tacky ink during the printing process (low linting propensity). Regardless of the printing technique applied, the printing quality of paper improves with improving surface smoothness. Therefore, the smoothness of all printing papers is enhanced by calendering the dry paper in one or several nips formed by polished calender rolls. The results of calendering of paper include decreased roughness and increased gloss, which are desirable, and reduced paper thickness which is desirable only for some grades. The undesirable results include a decrease in the tensile, tear and burst strength of paper, and a reduction of the cohesion of the superficial fibres and fines with the rest of the web. Superficial material which was partially detached by the action of calender rolls, or by other means, might be removed during printing of paper by tacky ink and accumulates on the printing plates. The accumulation of this "lint" on the printing cylinder or on the printing blanket causes the appearance of undesirable print "mottle". Therefore, linting propensity is a serious defect of printing papers.

Desirable properties of printing papers include low roughness, high gloss, large tensile ant tear strength, low linting propensity and no difference in the characteristics of the two sides of paper. While smoothness and gloss of paper can be improved by calendering, this treatment has a negative effect on the strength and linting propensity of paper. Therefore, other and more expensive methods, such as the application of more expensive pulps to furnish, are sometimes used to reduce the amount of calendering required to optimize the properties of printing papers made of mechanical pulps. Clearly it is desirable to develop a process which would produce a smoother and glossier paper, especially newsprint, without negatively affecting the strength and linting properties of paper.

The equality of the surface characteristics on the two sides of paper is another important requirement of printing grades of paper. The effect on the print quality of small, but consistent deviations from the optimum values of the surface roughness, gloss, or fines content might be to some extent compensated for by modification of process parameters on the printing machine. However, a difference in the printing characteristics of the two paper sides, so called two-sidedness, results in a very noticeable and therefore undesirable difference in the print quality of two facing pages.

The importance placed by the industry on two-sidedness has been demonstrated by conversion, during the last 20 years, of the majority of newsprint formers from fourdriniers to twin-formers. The lower two-sidedness of the sheet dewatered in a more symmetrical manner on a twin-former was the main driving force for these modifications. Paper proceeding through a conventional, cylinder dryer section contacts with its alternative sides the consecutive dryers, or series of dryers in the Total Bel Run arrangement. Drying through both sides has been considered essential to prevent the development of two-sidedness. Yankee or HG dryers have not been considered suitable for printing grades of paper because they produce creped or grossly two-sided products.

SUMMARY OF THE INVENTION

A method has been discovered for the continuous drying of endless cellulosic webs at a drying rate greater than that normally achieved on cylinder dryers. The paper dried according to this method is stronger, smoother, glossier, and has a greater surface strength than paper dried by conventional methods. The method is particularly suitable for drying wet cellulosic webs intended for printing products such as newsprint and bond paper. The method consists of drying a water-containing cellulosic web for paper on at least two heated cylinders in such a manner that one paper side is adjacent to the surface of the first cylinder and the other side is adjacent to the surface of the second cylinder.

In accordance with the invention the water-containing cellulosic web is fed onto a first heated cylinder and a first side of the web is pressed against a smooth surface of the first heated cylinder with the first side contacting the smooth surface. The resulting partially dried web is removed from the first cylinder and fed onto a second heated cylinder and is pressed against a smooth surface of the second heated cylinder with a second side of the web contacting the smooth surface of the second cylinder; the second side being opposed to the first side, whereafter the resulting dried cellulosic web is removed from said second cylinder. The pressing of the partially dried web against the smooth surface of the second cylinder is carried out by pressing with a smooth, impermeable press roll applied against the web in contact with the first side.

DESCRIPTION OF PREFERRED EMBODIMENTS

Suitably the first and second cylinders are large diameter cylinders, having a diameter of 3 to 8, usually about 6 meters, and the cylinders have a surface temperature of about 105° to 130° C., preferably about 118° C.

The nip load at the pressing of the web against the first and second cylinders is suitably 65 to 150 kN/m, preferably about 100 kN/m.

The web suitably travels :n contact with the cylinders at the regular velocity of the paper machine for example 600 to 1500 m/min., and the method is particularly suitable for machines operating at speeds above 1000 m/min. The drying rate achieved is between 70 and 100, typically about 85 kg/m$^2$h on the first cylinder and 15 to 30, typically about 25 kg/m$^2$h on the second cylinder.

In the first pressing stage the web is pressed against the first cylinder by pressing a porous, compressible substrate, for example, a felt, in contacting engagement with the second side of the web.

Thus in a particular embodiment the web, previously dewatered in a conventional press section, is pressed onto the first large diameter dryer by means of a felt, backed by a press roll equipped with some superficial cavities to accept water escaping from the press nip. The partially dried web is pressed to the second large diameter cylinder by an unfelted smooth press roll. The large diameter dryers operate without dryer fabrics and in the preferred embodiment, they are equipped with high velocity hoods, infrared heaters or other external means of drying. Drying of webs pressed on the surface of a smooth dryer leads to paper with higher strength, gloss, and smoothness than that of the conventionally dried paper. The smooth unfelted press roll on the second large diameter dryer preserves the paper smoothness developed on the first dryer. The drying rates obtained by this method are 6 to 10 times greater than those achieved on conventional dryer sections.

BRIEF DESCRIPTION OF DRAWINGS

The invention is illustrated in particular and preferred embodiments by reference to the accompanying drawings in which:

FIG. 6 illustrates schematically a pilot drying machine for carrying out the method of the invention.

DESCRIPTION OF PREFERRED EMBODIMENTS WITH REFERENCE TO THE DRAWINGS

Figure 1:
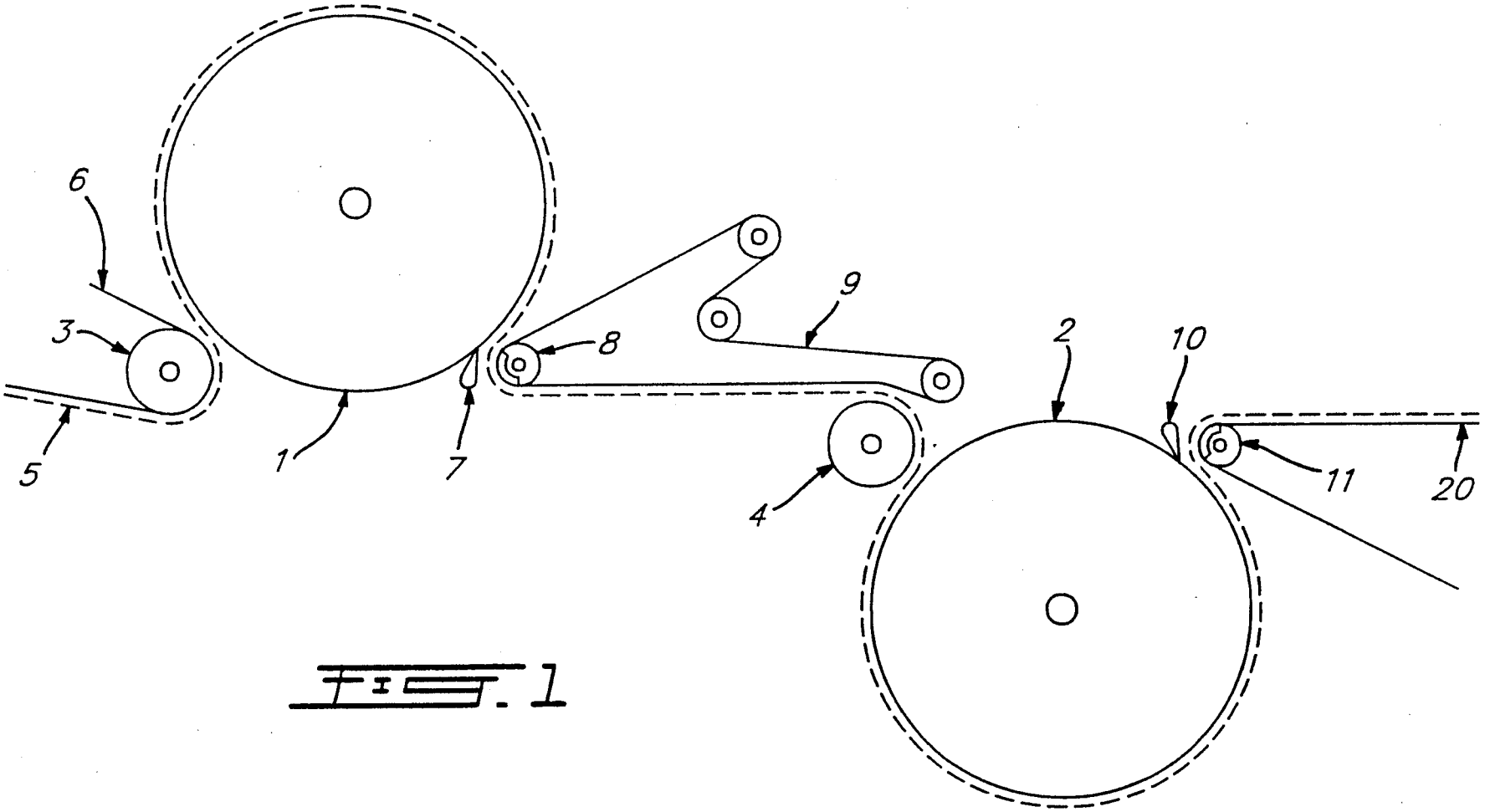
FIG. 1 illustrates schematically a drying apparatus for use in the method of the invention.

The drying apparatus consists of two large diameter cylinders 1, 2 and two press rolls 3, 4 equipped with web transfer devices (FIG. 1). Web 5, is carried by the press felt 6 to the nip formed by the press roll 3 and dryer 1. The transfer device consists of an air doctor 7, and a vacuum roll 8. The combined effect of the air doctor 7 and the vacuum roll 8 transfers the web from dryer 1 to the conveyor fabric 9. The web is picked up by the solid smooth press roll 4 and pressed onto the second dryer 2. The partially or completely dried web is removed from the dryer 2 by the air doctor 10 and, with the assistance of the vacuum roll 11 is transferred on the conveyor fabric 20 which carried it to the subsequent machine part such as an after-dryer or a calender.

The web 5 arrives to dryer 1 from a conventional press with a solids content between about 30% and 46% as it enters the nip formed by the press roll 3 and the dryer 1. In the press nip, the web is compressed by the press felt 6 to the dryer surface and an intimate contact is established between the web fibres and the surface of the dryers. The nip loads required to establish such a contact resemble those commonly used in the press sections of paper machines (I. I. Pikulik and I. T. Pye, Survey of Press Sections of Canadian Pulp, Paper and Board Machines, TS CPPA, Montreal, 1986). Higher nip loads, for example those above 100 kN/m, might lead to a better water removal in the press nip and a slightly greater solids content of web leaving the nip. However, we have found that high nip loads are not required for the achievement of high heat transfer rates, and therefore high drying rates. Relatively low nip loads similar to those often used in conventional first presses, for example 25 to 40 kN/m are sufficient for development of an adequate drying rate on the first dryer. On the other hand, high nip loads enhance the development of high gloss and the smoothness of paper, low roughness and higher paper gloss are obtained when press nip loads of 40 to 150 kN/m are used.

Figure 2:
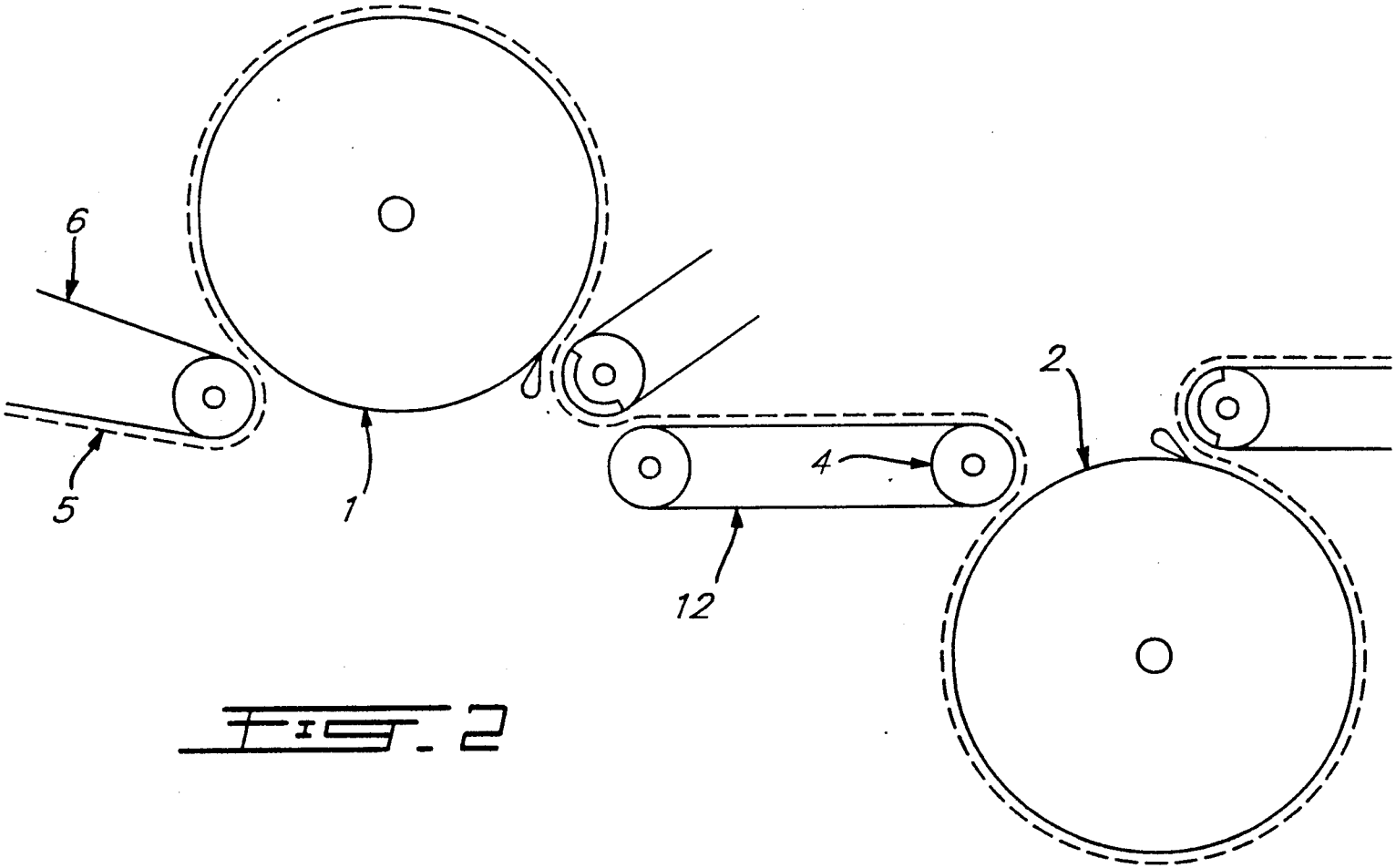
FIG. 2 illustrates schematically a modified drying apparatus which is not satisfactory.

The surface of the dryers 1 and 2 is smoothly polished because characteristics of roll surface are duplicated on the paper surface and a low roughness is desirable for good printing properties of paper. As is common with MG cylinders or dryers of tissue machines, the backing press rolls 3 might be equipped with some cavities such as suction holes, blind drilled holes, or grooves, which can receive water expressed from the web and press felt. On the other hand, the press roll 4 must be smooth without any large superficial features. Roll 4 is in contact with the smooth and glossy side of paper which was previously glazed by dryer 1. In a conventional felted press nip, such as that formed between dryer 1 and roll 3 or between conventional press rolls, one paper side is compressed against the surface of the press felt. The surface of the felt is rougher and stiffer than that of moist paper. Compression of the smooth bottom side of web 5 in a conventional manner, that is by a press felt 12 as shown in FIG. 2 increases the roughness and decreases the gloss of this paper side, and largely eliminates improvements of the paper surface achieved on the first dryer. Therefore, a unique feature of this invention is the compression of the web by a smooth, impermeable roll 4 on the surface of heated cylinder 2. Conventional press roll covers made of hard rubber or other material are suitable for this roll. Loads in the nip formed by press roll 4 and dryer 2 will depend on the desired properties of the product. Higher nip loads increase the drying rate on the second dryer and smoothness of the top side of paper. The smoothness of the top paper side is also greater if the humidity of paper arriving at the second dryer is increased. Equal smoothness and gloss of the two paper sides can be achieved by adjusting dryer surface temperature, parameters of high velocity hoods, and nip loads of the two dryers.

Figure 3:
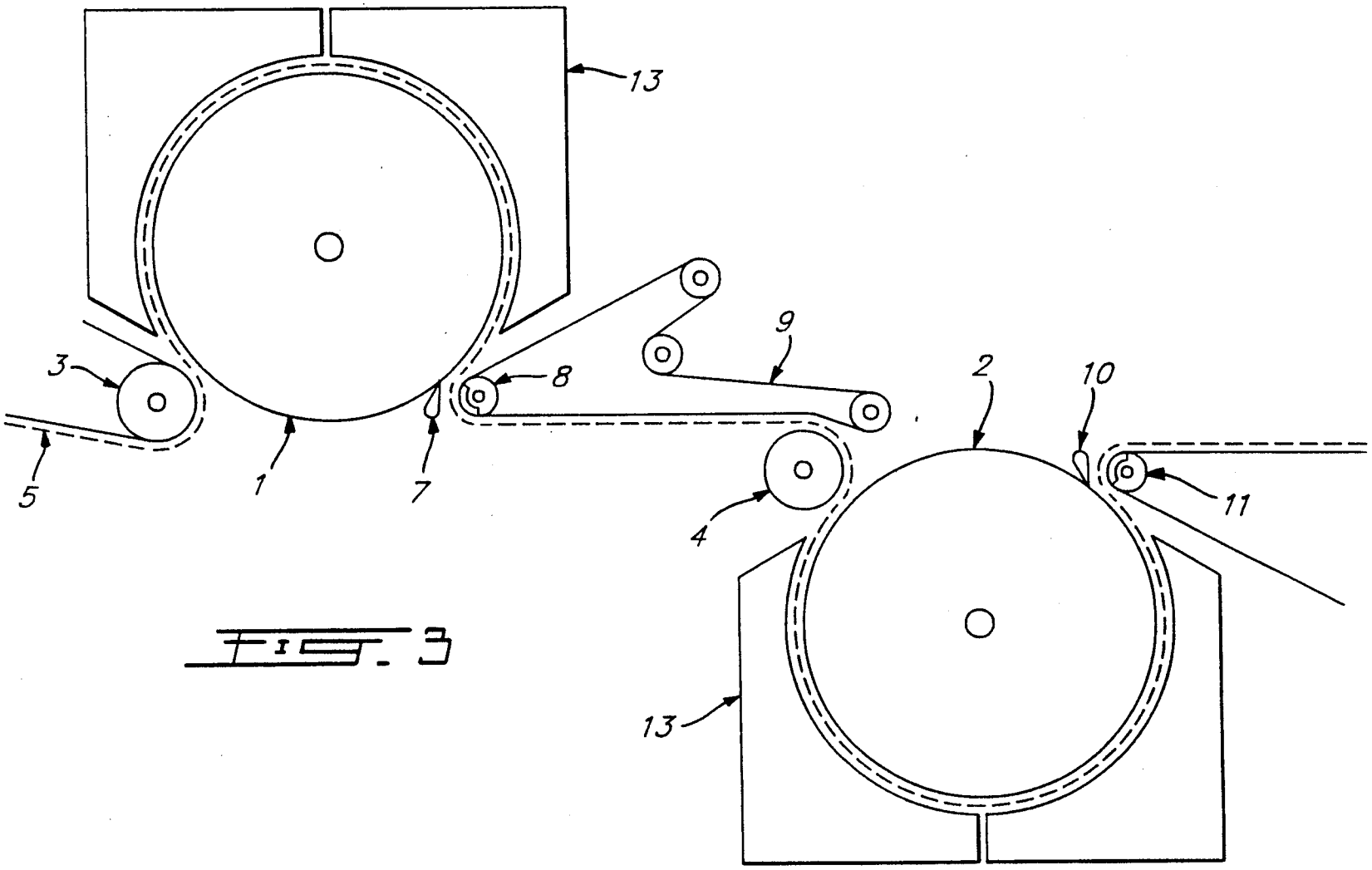
FIG. 3 illustrates schematically a drying apparatus for use in the method of the invention equipped with a high velocity hood.

Water removal capacity of a dryer is doubled when it is equipped with a so called high velocity hood as indicated in FIG. 3. The jets of preheated air which impinge from the high velocity hood 13 on web 5 as it proceeds around the dryer provide the heat required for evaporation of water and carry away water vapour away from the vicinity of the paper. The high velocity hood can be used when this invention is applied to high speed machines, heavy basis weight printing papers, or whenever an increase in the drying capacity is required. The construction and operating parameters of the high velocity hood are not the subject of this invention. A hood such as that described by T. Gardner [Tappi, 47(4) 210 (1964)] or other efficient hoods could be employed. Alternatively, other external heat sources, for example infra red heat could be used to increase the drying rate.

When the wet web is dried according to this invention almost all water is evaporated from the web which is in close contact with the smooth surface of dryers. Under these conditions the web cannot preferentially shrink in certain areas and develop deviation from planarity. Therefore paper dried to a solids content above about 80% on two large diameter driers does not develop the undesirable small scale deviation from planarity or "cockle".

Dryers 1 and 2 can be heated by various means, such as internally by compressed steam or direct flame, electrical induction, infrared radiation or externally e.g. by electrical induction or other means. The majority of Yankee dryers and MG cylinders currently used, are heated internally by medium pressure steam, and similar techniques are also applicable to the present invention. The optimum temperature of the dryer surface will depend on the properties of the web. If the dryer temperature is too high and the web has a low permeability to water vapours, a layer of pressurized steam could develop between the dryer surface and the paper in a manner similar to that used in impulse drying. At high machine speeds and short nip residence time this steam would not displace liquid water as it occurs during impulse drying, but it could partially separate the web from the dryer wall, reduce the area of intimate contact between the dryer and the fibres. This would result in a lower heat transfer rate and a slower rate of drying. Too low a temperature at the drier surface would result in a low temperature difference between paper and dryer, and therefore a low heat transfer rate, and a low rate of drying. The dryer surface temperature might range from about 100° C. to about 170° C., and temperatures in the range of 108° C. to 140° C. were found to be especially convenient for the drying of newsprint.

The amount of water removal on the dryers described in this invention depends on the web-dryer contact time which, in turn, depends on the diameter of the dryers and on machine speed. The diameter of the dryers is determined by the basis weight of products, moisture content in the pressed web, and machine speed. Dryers with large diameters can provide the residence time required for complete drying of low basis weight printing grades. However, various practical reasons restrict the size of dryers. For example, modern machines producing creped papers usually employ a single dryer with a diameter of about 6 to 7 m.

The best fibre-cylinder contact, and consequently the highest drying rate is developed when the web is pressed to the dryer surface at a low solids content, because cellulosic fibres swollen with water are maleable and conform to the surface of the dryer. Therefore the highest drying rates are obtained when a web is pressed to, and completely dried on a single cylinder. However, the drying capacity of a single cylinder is too low for a fast paper machine. Also, paper dried on a single dryer adheres too strongly to its surface, is difficult to peel from the dryer, and is very two-sided. To avoid these problems, paper has to be dried on at least two cylinders. In the preferred embodiment of the invention, the web is pressed on the first dryer cylinder with the solids content similar to that obtained at the end of a conventional press section, namely 35% to 50%. The web is removed from the first cylinder at a solids content of 55% to 75% and pressed to the second dryer. At this higher solids content, the cellulosic fibres are less swollen, more rigid and a less perfect contact with the surface of the second dryer will be established upon pressing. For this and other reasons, the rate of drying is lower on the second dryer than on the first dryer.

Figure 4:
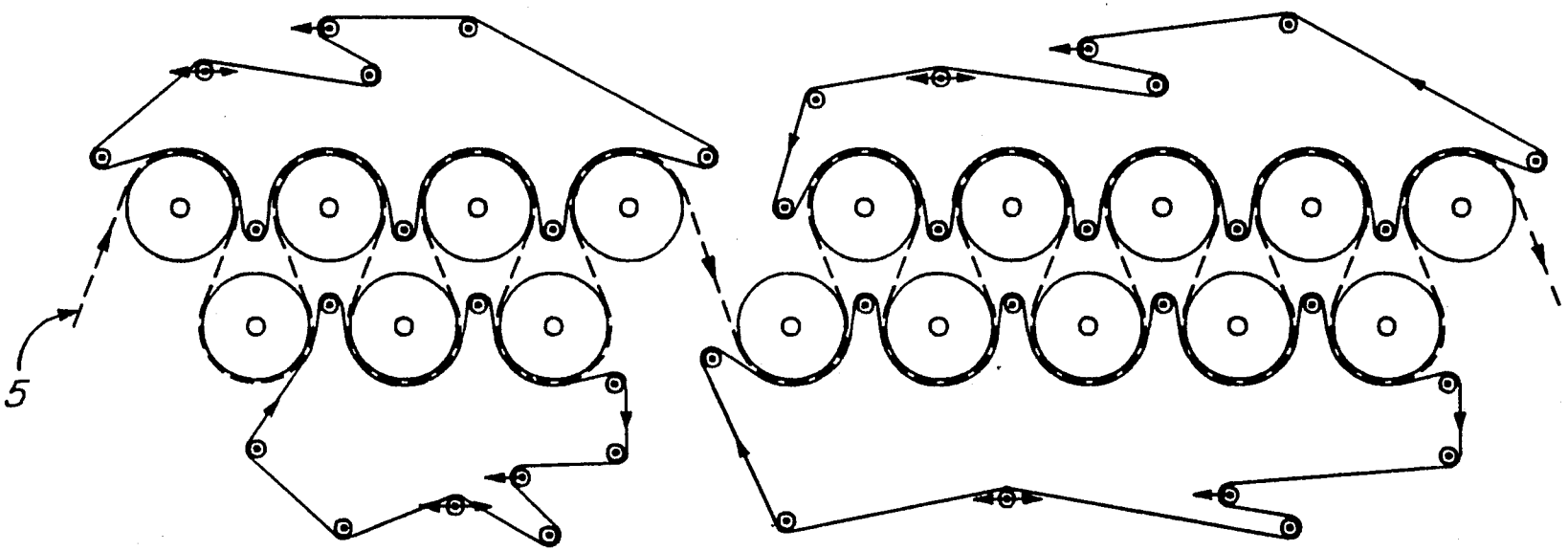
FIG. 4 (PRIOR ART)
FIG. 4 illustrates schematically a conventional dryer assembly.
Figure 5:
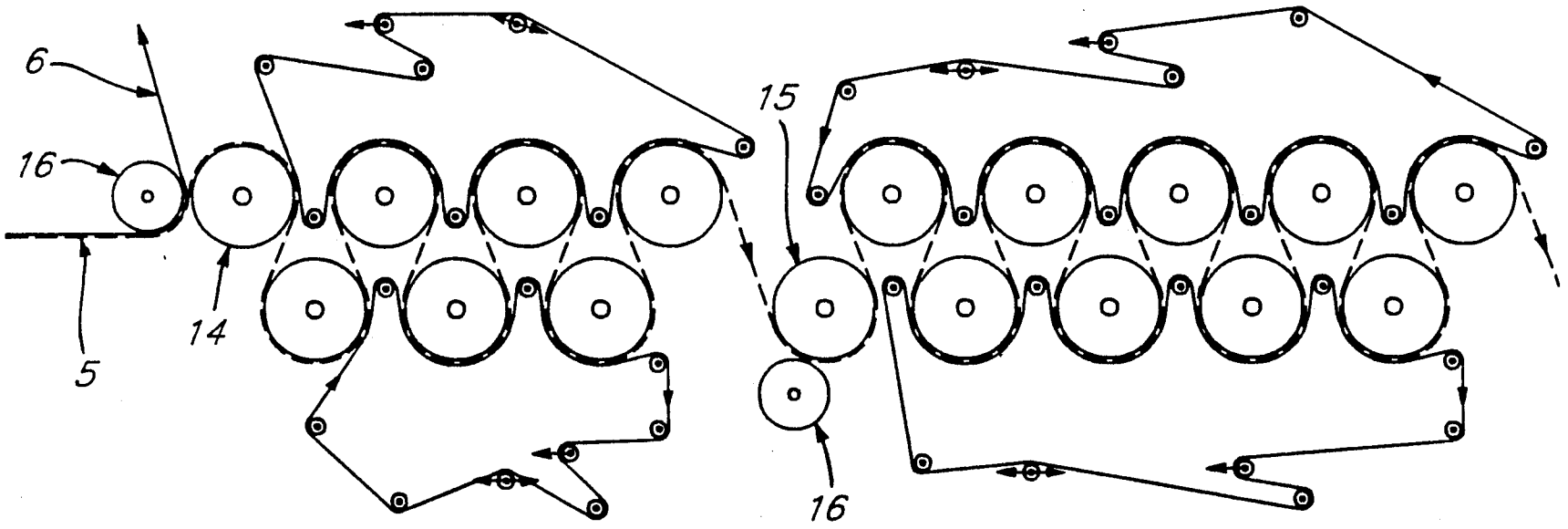
FIG. 5 illustrates schematically the conventional dryer assembly of FIG. 4 modified to incorporate a drying apparatus for carrying out the method of the invention.
Figure 8:
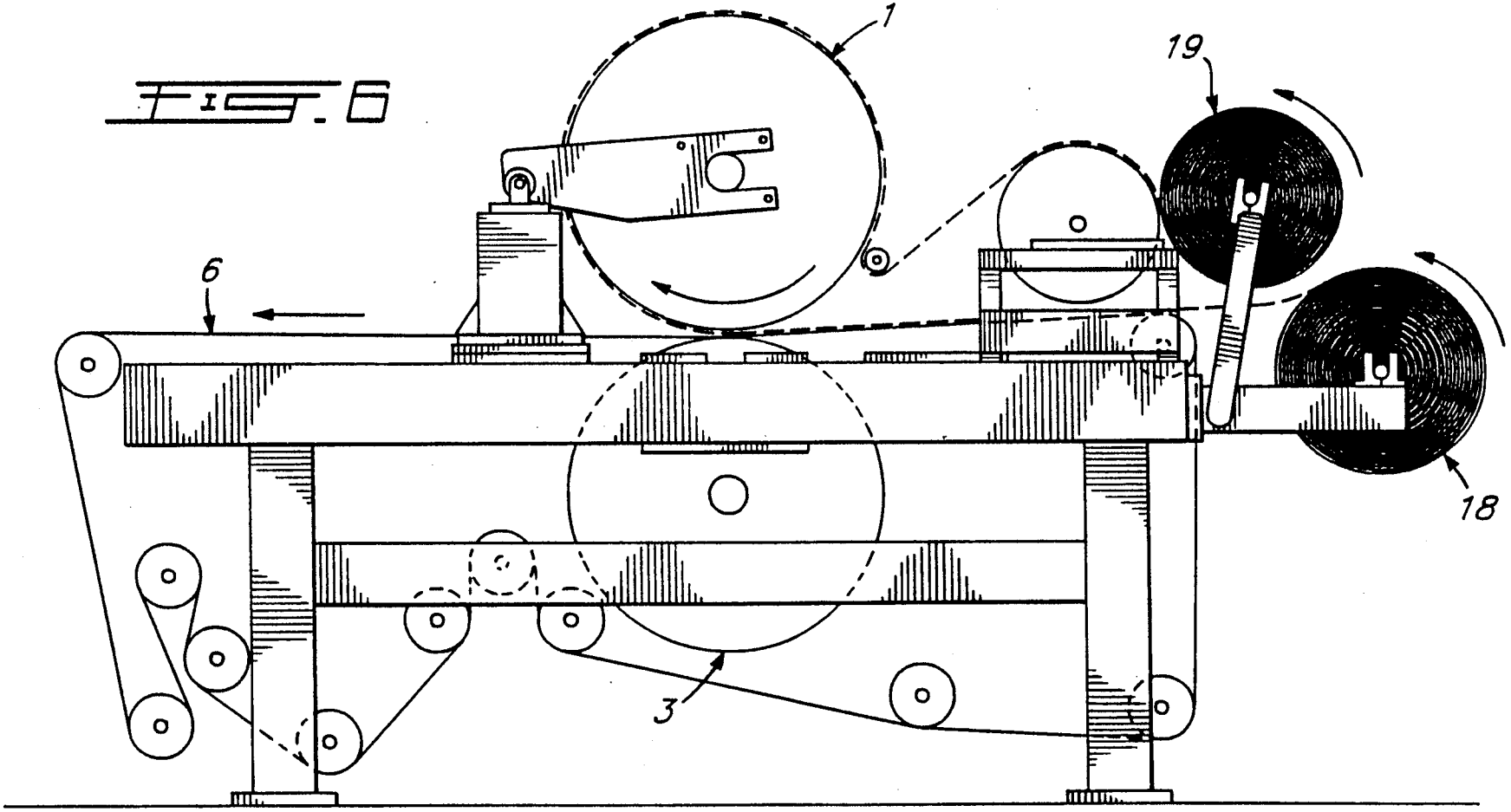

In the preferred embodiment, paper is dried to its final solids content, namely about 90%, on just two large diameter dryers, as this method of drying provides a high drying rate, good paper surface smoothness and gloss and improved paper strength. A smaller, but still substantial improvement in the paper smoothness and gloss can be obtained when paper is pressed to a dryer with a smaller diameter. Paper partially dried in this manner can then be dried further by other methods. The two dryers equipped with presser rolls could be installed within conventional cylinder dryer section to improve the surface properties of the product. A scheme of a conventional dryer section is shown in FIG. 4. A conventional dryer section modified by installation of two press roll equipped dryers is shown in FIG. 5. The dryer section modified as shown in FIG. 5 provides an increased rate of drying only on two dryers, 14 and 15, to which paper is pressed by press rolls 16. Additional dryer cylinders can be equipped with press rolls if further increase in the drying capacity and improvemnt in the paper surface properties is desirable. However, press rolls acting on the wet webs on the initial dryers where the web solids content is too low, must be felted to provide a route for escape of water removed from paper in the press nip, and press rolls acting on dryer webs (for example with solids content of 57% or greater), should be unfelted and smooth to prevent marking of the sheet. Paper could be pressed to any dryer cylinder, however, as the web solids content increases, beneficial effects of web pressing on dryers declines.

The combined effect of high heat transfer rate from the dryer and impingement of hot air from a high velocity hood produce a high drying rate. For example, drying rates of 160 kg water per $m^2$ per hour are achieved at dryers of tissue machines. In our trials, described below, drying rates of about 90 kg water per $m^2$ per hour were obtained when drying newsprint, even without the assistance of air impingement. In comparison, the average drying rate on conventional newsprint drying cylinders is only about 15 kg water per $m^2$ per hour (TAPPI Technical Information Sheet 0404-15, revised in 1986).

In the preferred embodiment, the web is dried on two dryers with diameters of about 5–7 m. Two large diameter dryers, even if equipped with high velocity hoods, might not be able to entirely dry the web on very rapid machines, especially if they produce products with a higher basis weight. If more drying capacity is required, additional dryers can be used to complete drying of the web after the second dryer. In this configuration, the web pressed onto the dryer surface has a relatively low solids content, as required for the development of good paper surface properties. Once high gloss and smoothness are achieved in the paper, after drying on the two consecutive large dryers to a solids content of 70% or more, these desirable properties are retained in paper which was subsequently dried by other means. This additional drying can be accomplished on conventional drying cylinders, or by other technique. For example, the excessive moisture which remains in the web leaving the second dryer could be evaporated on a dryer which combines the air impingement with an air passage through the sheet (U.S. Pat. No. 3,248,798), and which is known as Papridryer.

The following are some examples of experiments made using the process of this invention:

EXAMPLE 1

Showing that paper pressed to just one dryer is stronger, and has one smooth and one glossy side.

Newsprint sheet with a basis weight of 50 g/$m^2$ was prepared on a pilot paper machine equipped with a twin former and operating at 800 m/min, from a furnish composed of 18% softwood kraft pulp and 82% stone groundwood pulp. The sheet was pressed on a paper machine in two press nips loaded to 45 and 90 kN/m respectively, and reeled at a solids content close to 40%. Further treatment of the sheet was carried out on the pilot drying machine shown in FIG. 6. The wet paper was unwound from the reel 18 and carried at a speed of 100 m/min by the press felt 6 into a nip formed by the press roll 3 and dryer roll 1. The dryer roll was heated externally by electrical induction. The press nip load was 100 kN/m and the roll temperature was about 125° C. The diameter of the press roll 3 was 0.76 m and that of the dryer 1 was 0.88 m. The residence time of paper on the dryer roll was about 1.60 s which corresponds to a residence time on a dryer with a diameter of 6 m, operating at 700 m/min. The solids content of the sheet at reel 18 was 39.2% and of that at reel 19 was 61.2%. This corresponds to a drying rate of 104 kg water per $m^2$ of dryer per hour.

In a control experiment, a similar sheet was pressed under similar conditions, however, the dryer 1 was not heated. Samples from both experiments were completely dried on a rotary photographic dryer while sandwiched between two blotters, conditioned overnight at 25° C. and 50% relative humidity and tested. Some physical and surface properties of both samples are presented in Table I.

TABLE I

Selected Properties of a Newsprint Sample Dried According to This Invention and of a Control Sample

| Sample | Smoothness PPS-S10 (μm) | | Hunter Gloss 75% (%) | | MD Breaking Length (km) | Tensile Energy Absorption (mJ/g) | Tear Index ($mNm^2/g$) |
|---|---|---|---|---|---|---|---|
| | Top Side | Bottom Side | Top Side | Bottom Side | | | |
| Control | 6.4 | 6.8 | 5.6 | 5.0 | 3.5 | 245 | 6.3 |
| Paper treated on one side only | 3.5 | 7.6 | 19.2 | 4.6 | 4.8 | 397 | 6.2 |

Surface properties measured on both sides of the control sample which was pressed on a cold dryer roll, namely PPS-S10 of about 7 m and Hunter gloss close to 6% are typical for conventionally-made uncalendered newsprint. The roughness and gloss of the bottom side of paper which was pressed against the felt and then proceeded around the heated press roll, were similar to those measured for the control sample. On the other hand, the top side of the sample which was directly adjacent to the dryer surface was much smoother and glossier than that of the control sample, or of conventionally dried newsprint paper.

Although the properties listed in Table I were measured on uncalendered paper, the PPS-S10 roughness of 3.5 and Hunter gloss of 19% found on the top side of newsprint dried according to this invention are similar to those usually obtained only on fully-calendered newsprint. This indicates that paper made according to this invention requires either substantially less calendering than the conventional paper or no calendering at all. Since about 30% of paper tensile strength is normally lost during calendering, paper made according to this invention can retain more of its original strength. A commonly used criterion of paper strength is the breaking length, which is the length of the paper strip at which it would break by its own weight. Using this criterion, the sample dried according to this invention was 37% stronger than the control sample. The tensile energy absorption (TEA), is a reflection of both the tensile strength and stretch of paper. Paper prepared according to the invention had TEA 38% greater than the control sample. While an increase of the tensile strength by conventional methods, such as by refining or by addition of strength chemicals, is often accompanied by a decline of the tear strength, this negative effect did not occur when the invention was applied.

EXAMPLE 2

Showing that smoothness developed on the first dryer is destroyed by pressing paper with a felt to the second dryer.

Wet newsprint web was prepared as described in Example 1, and treated on the pilot dryer machine shown in FIG. 6. Paper was unwound from reel 18, passed through the press nip and over the dryer 1 and collected on reel 19. A sample of paper treated in this manner was removed, and reel 19 was relocated to position 18. The sheet was then passed again through the nip and over the dryer in such a manner that the paper side that had faced the felt during the first pass faced the dryer on the second pass. Solids content of the initial paper was 43.8%, after the first pass 76.3%, and after the second pass 80.3%. Some parameters of operation and paper test results from this experiment are shown in Table II.

Data in Table II indicate that on the first pass through the drying machine, a substantial improvement of roughness and gloss occurred on the top sheet surface, which was in contact with the dryer roll. The bottom side of the sheet which, during the first pass was pressed against the felt, had its roughness unchanged, and its gloss improved only marginally when compared with the control sheet.

TABLE II

| | Some Operation Parameters and Paper Properties. | | | | | | |
|---|---|---|---|---|---|---|---|
| | Dryer Temp. (°C.) | Nip Load (kN/m) | Drying Rate (kg/m²h) | Roughness PPS-S10 (μm) | | Hunter gloss 75° (%) | |
| | | | | Top | Bottom | Top | Bottom |
| Starting sheet | | | | 6.9 | 7.2 | 6.2 | 6.8 |
| First pass | 121 | 150 | 85 | 4.1 | 7.2 | 10.8 | 9.8 |
| Second Pass pressed by a felt | 100 | 150 | 25 | 5.8 | 3.6 | 6.9 | 16.5 |

During the second pass, the bottom side of the paper was pressed against the dryer surface. As shown in Table II, this resulted in a dramatic decrease in roughness, which dropped to 3.6 m, and improvement in gloss, which increased to 16.5%. Similar values of roughness and gloss are usually found on fully-calendered newsprint paper. In contrast with this, surface characteristics of the bottom side of the paper deteriorated during the second pass. Subsequent to a compression by the press felt in the second nip formed by the press roll and the dryer, the gloss and roughness of the paper top side became similar to that found on uncalendered conventional newsprint.

This example demonstrates that a substantial improvement of the bottom paper surface can be achieved, even on the second dryer onto which the web is pressed by means of a felted roll as it is practiced in conventional MG or Yankee drying. However, such an operation destroys the smoothness of the paper's top side. Furthermore, the experiment indicates that a substantially higher drying rate, namely 80.5 kg/m²h is achieved on web which was pressed onto the dryer at a low solids content of 43.8% than the drying rate (25.3 kg/m²h) achieved when the same web is introduced at a higher starting web solids content of 67.3%. It is therefore desirable to dry paper on just two, large diameter dryers as this allows operation with the highest incoming web solids contents. In this experiment, the dryer residence time of paper was similar to that achieved on a 6 m diameter dryer operating at 700 m/min. Therefore, this result indicates that two dryers on a commercial machine could increase the solids content of newsprint from about 44% to about 80%, even when they are not equipped with air impingement hoods.

EXAMPLE 3

Showing improvements in smoothness, strength and printing quality of paper dried according to this invention.

The newsprint web was prepared as described in Example 1, and treated on the pilot dryer machine shown in FIG. 6, equipped with a smooth, hard press roll 3. Paper was unwound from reel 18 in the press nip, was compressed between the felt 6 and the dryer 1, proceeded around the dryer 1, and was collected on the reel 19. The reel 19 with the partially dried and was collected on the reel 19. The reel 19 with the partially dried paper was then relocated to the position 18 and the felt 6 was removed. The sheet was passed again through the nip formed by the smooth roll 3 and dryer 1, proceeded over the dryer in such a manner that the paper side that contacted the felt during the first pass faced the dryer during the second pass, while the reverse side faced the hard and smooth press roll. This procedure simulated the apparatus shown in FIG. 1. The solids content of the original paper was 37.9%, after the first pass 66.3%, and after the second pass 74.8%. Samples were removed from the original paper and paper treated according to this invention, and both were dried sandwiched between blotters on a photographic dryer.

Some physical properties of the paper prepared according to this invention are in Table III. Compared with those of the control sample, the sample prepared according to the invention had almost 50% greater breaking length and internal bond, and had more than twice the tensile energy absorption. The control sample had somewhat greater tear index and scattering coefficient and both samples have similar opacity. This example demonstrates the surprising improvement in the strength and smoothness of newsprint dried according to this invention, and also indicates that the difference in the smoothness of two paper sides created on the first dryer can be eliminated on the second dryer.

TABLE III

| | Properties of Newsprint Dried on Two Consecutive Dryers According to this Invention | | | | | | | |
|---|---|---|---|---|---|---|---|---|
| | Parker Print Smoothness μm | | Breaking Length, MD | Stretch MD | TEA* | Tear Index | Internal Bond, MD | TAPPI |
| Sample | Top | Bottom | km | % | mJ/g | $mNm^2/g$ | $kJ/m^2$ | Opacity % |
| Control | 8.0 | 7.6 | 4.1 | 1.0 | 11.0 | 4.4 | 157 | 91.4 |
| Invention | 4.5 | 4.8 | 6.1 | 1.4 | 25.7 | 3.6 | 307 | 91.0 |

*Tensile Energy Absorption

Paper characterized in Table III was pressed at 100 kN/m and dried on a cylinder heated to about 118° C. Other paper samples which were pressed at lower nip loads such as 20 or 60 kN/m or dried at a higher temperature, such as 145° C., were weaker and rougher, indicating that the optimum operating conditions are close to 118° C. and 100 kN/m. Compared with conventionally pressed paper, the paper described in Table III develops the required bulk and smoothness with less calendering. An important quality criterion of printing paper grades is the print density index, which is a measure of the surface darkness achieved by a certain quantity of ink. Table IV indicates that, although the paper prepared according to this invention was only lightly calendered, it had a print density index similar to that of heavily calendered conventional paper.

TABLE IV

| | Printing Properties of Paper Dried According to this Invention | | | | | |
|---|---|---|---|---|---|---|
| Drying | Calender nip | Smoothness (PPS, μm) | | Print density index ($m^2/g$) | | Bulk |
| Conditions | loads (kN/m) | Top | Bottom | Top | Bottom | ($cm^3/g$) |
| Conventional | 20 + 40 + 60 | 2.98 | 2.88 | 0.42 | 0.29 | 1.48 |
| Invention | | | | | | |
| 60 kN/m, 120° C. | 20 + 40 | 2.95 | 2.86 | 0.39 | 0.39 | 1.46 |
| 100 kN/m, 120° C. | 20 | 3.24 | 3.28 | 0.36 | 0.41 | 1.39 |

EXAMPLE 4

Showing web solids contents which can be obtained on two large diameter dryers equipped with press rolls.

At a specified drying rate, the amount of water removed from a web pressed onto a heated cylinder depends on the web residence time. The average drying rates obtained in several experiments similar to those described in Examples 2 and 3 were 88 $kg/m^2h$ for the first pass and 23 $kg/m^2h$ for the second pass. If it is assumed that similar drying rates could be obtained on a large diameter industrial dryer, the solids content obtainable at various machine speeds could be calculated. Table V contains solids contents calculated for a newsprint sheet with a basis weight of 50 $g/m^2$ previously pressed to a solids content of 45% and dried on two 6 m diameter driers, the perimeter of each of which is wrapped by the web, for a distance of 17 m. Drying rates of 88 $kg/m^2h$ and 23 $kg/m^2h$ are assumed for the two passes.

TABLE V

| Calculated Solids Content of Newsprint After the First and Second Dryer, at Three Machine Speeds for Two Dryers Without Hoods. | | | | | |
|---|---|---|---|---|---|
| Speed | Dryer Residence | Drying Rate $kg/m^2h$ | | Web Solids Content (%) | |
| (m/min) | Time (s) | 1st Dryer | 2nd Dryer | After 1st Dryer | After 2nd Dryer |
| 700 | 1.46 | 88 | 23 | 66 | 76 |
| 1000 | 1.02 | 88 | 23 | 58 | 62 |
| 1300 | 1.78 | 88 | 23 | 54 | 57 |

Experience with Yankee drying of tissue indicates the drying rate can be doubled by impingement of the hot air from high velocity hood on the web proceeding on the surface of a heated drying cylinder. Assuming that the drying rates obtained on our pilot drying machine could be doubled by impingement of hot air as indicated in FIG. 3, then drying rates obtained on the first and second dryers would be 176 and 46 $kg/m^2h$. Table VI presents solids contents calculated for the same conditions as those described in Table V, but assuming that both dryers employ a high velocity hood.

TABLE VI

| Solids Content Calculated for Dryers Equipped with High Velocity Hoods. All Other Conditions Are Similar to Those Assumed for Data in Table IV | | | | | |
|---|---|---|---|---|---|
| Speed | Dryer Residence | Drying Rate $kg/m^2h$ | | Web Solids Content (%) | |
| (m/min) | Time (s) | 1st Dryer | 2nd Dryer | After 1st Dryer | After 2nd Dryer |
| 700 | 1.46 | 176 | 46 | 100 | 100 |
| 1000 | 1.02 | 176 | 46 | 81 | 100 |
| 1300 | 0.78 | 176 | 46 | 68 | 79 |

The average speed of Canadian newsprint machines in 1986 was about 700 m/min [N. N. Sayegh and I. I. Pikulik, Pulp Paper Can., 88 912) T470 (1987)], and, at the present time, only a few of the fastest machines operate at speeds in the vicinity of 1300 m/min. Data in Table V indicate that two dryers with a diameter of 6 m, equipped with high velocity hoods would be capable of completley drying newsprint on all but a few of the fastest machines.

I claim:

1. A method of drying an endless water-containing cellulosic web to produce a dried web with opposed smooth sides comprising:

feeding a water-containing cellulosic web having a solids content of 35% to 50%, by weight, and having first and second opposed sides onto a first heated cylinder, pressing said web against a smooth surface of the first heated cylinder with said first side contacting said smooth surface, by pressing a porous, compressible substrate in contacting engagement with said second side and allowing water to escape from said cellulosic web through said porous, compressible substrate, to partially dry said cellulosic web and render said first side smooth, removing a partially dried cellulosic web having a smooth first side from said first cylinder, feeding and partially dried web onto a second heated cylinder, pressing said partially dried web against a smooth surface of the second heated cylinder with said second side contacting said smooth surface of said second cylinder to further dry said web, said pressing of the partially dried web against said smooth surface of the second cylinder being carried out with a smooth, impermeable press roll, rolled against said web in contact with said smooth first side, and removing the resulting dried cellulosic web having opposed first and second smooth sides from said second cylinder.

2. A method according to claim 1, wherein said porous, compressible substrate comprises a felt, and said pressing comprises pressing said felt against said second side with a press roll having means to accept water expelled from said web, through said felt, at a nip between said press roll and said first cylinder.

3. A method according to claim 1, wherein said partially dried web removed from said first cylinder has a solids content of 55% to 75%, by weight.

4. A method according to claim 1, including impinging said second side of said web with hot air at said first heated cylinder to effect supplementary drying of said web, and impinging said first side of said web with hot air at said second heated cylinder to effect supplementary drying of said web.

5. A method according to claim 1, in which said smooth first and second sides have substantially identical smoothness characteristics and said dried cellulosic web is recovered as a non-calendered paper.

6. A continuous method of drying an endless water-containing cellulosic web to produce a dried web with opposed smooth sides in the production of paper comprising:

dewatering a water-containing cellulosic web having first and second opposed sides to a solids content of 35% to 50%, by weight, feeding the dewatered web onto a first heated cylinder having a smooth surface with a surface temperature of 105° to 130° C., pressing said web against said smooth surface of the first heated cylinder, with said first side contacting said smooth surface at a nip load of 65 to 150 kN/m, by pressing a porous, compressible substrate in contacting engagement with said second side and allowing water to escape from said cellulosic web through said porous, compressible substrate, to partially dry said cellulosic web and render said first side smooth, removing a partially dried web having a solids content of 55 to 75%, by weight, and a smooth first side from said first cylinder, feeding said partially dried web onto a second heated cylinder having a smooth surface with a surface temperature of 105° to 130° C., pressing said partially dried web against said smooth surface of said second cylinder with said second side of said web contacting said smooth surface of said second cylinder at a nip load of 65 to 150 kN/m, to further dry said web, said pressing of the partially dried web against said second heated cylinder comprising rolling a smooth, impermeable press roll against said web in contact with said smooth first side, and recovering the resulting, non-calendered web in which said first and second opposed sides are smooth and have substantially the same paper characteristics, from said second cylinder.

7. A method according to claim 6, wherein said porous, compressible substrate comprises a felt, and said pressing comprises pressing said felt against said second side with a press roll having means to accept water expelled from said web, through said felt, at a nip between said press roll and said first cylinder.

8. A method according to claim 7, including impinging said second side of said web with hot air at said first heated cylinder to effect supplementary drying of said web, and impinging said first side of said web with hot air at said second heated cylinder to effect supplementary drying of said web.

9. Apparatus for drying an endless water-containing cellulosic web to produce a dried web with opposed smooth sides comprising:

a first rotatable cylinder having a smooth cylindrical surface, press roller means adapted to press, under a nip load, a first side of an endless travelling water-containing cellulosic web into contact with said smooth cylindrical surface of said first cylinder, a second rotatable cylinder having a smooth cylindrical surface adapted to contact a second side of said web, downstream of said first cylinder, a smooth, impermeable press roll adapted to contact the first side of the cellulosic web and press the web against said smooth cylindrical surface of said second cylinder, means to feed a compressible felt over said press roller means between said web and said press roller means, and means to heat the cylindrical surfaces of the first and second cylinders.

10. Apparatus according to claim 9, further including drive means to rotate the first and second cylinders.

11. Apparatus according to claim 10, wherein said press roller means comprises a press roll having means to accept water expelled from said web, through the felt, at a nip between the press roll and the first cylinder.

12. Apparatus according to claim 11, including hot air impinging means adapted to impingingly direct hot air at the second side of the web at said first cylinder and at the first side of the web at said second cylinder.

* * * * *